US006695225B2

(12) United States Patent
Yanagida

(10) Patent No.: US 6,695,225 B2
(45) Date of Patent: Feb. 24, 2004

(54) SPRAYER DEVICE

(75) Inventor: Jun Yanagida, Tagata-gun (JP)

(73) Assignee: Spray Devices Technology SDN BHD, Penang (MY)

( * ) Notice: Subject to any disclaimer, the term of this patent is extended or adjusted under 35 U.S.C. 154(b) by 197 days.

(21) Appl. No.: 09/904,498

(22) Filed: Jul. 16, 2001

(65) Prior Publication Data

US 2002/0008164 A1 Jan. 24, 2002

(30) Foreign Application Priority Data

Jul. 17, 2000 (JP) ..... 2000-215592

(51) Int. Cl.[7] ..... A62C 5/02; A62C 5/00; A62C 11/00; B05B 9/00

(52) U.S. Cl. ..... 239/333; 239/302; 239/311; 239/310; 239/124

(58) Field of Search ..... 239/333, 302, 239/311, 310, 314, 316, 334, 344, 337, 347, 308, 353, 354, 366, 368, 124, 127, 525, 526, 527; 222/383, 321, 375, 340

(56) References Cited

U.S. PATENT DOCUMENTS 3,774,844 A * 11/1973 Walberg ..... 239/695
4,646,969 A * 3/1987 Sorm et al. ..... 239/106
4,925,101 A * 5/1990 Konieczynski et al. ..... 239/8
5,338,495 A * 8/1994 Steiner et al. ..... 261/28
5,704,550 A * 1/1998 Foster et al. ..... 239/333
6,000,626 A * 12/1999 Futo et al. ..... 239/74

* cited by examiner

*Primary Examiner*—Davis Hwu
(74) *Attorney, Agent, or Firm*—Birch, Stewart, Kolasch & Birch, LLP

(57) ABSTRACT

A sparing device comprising of a liquid storage tank (22) for storing liquid (21) and a spraying mechanism (24) for spraying the liquid from the liquid storage tank (22) through a nozzle (23). Said spraying member further includes a trigger member (26) rotatingly fixed to a free axle, a first liquid pipe (29) which is provided with a suction valve (30) and exhaust valve (32) which is activated by the movements of the trigger member (26) and the piston (28), a pressure accumulator (31) which is supported by a spring member (34), a second liquid pipe (37), a third liquid pipe (38) wherein one end of the third liquid pipe is connected to the liquid storage tank and the other end is branched to the second liquid pipe and a seesaw button (40) to seal and seal the liquid passage way in the second and third liquid pipes alternatively to allow the liquid to flow through.

2 Claims, 9 Drawing Sheets

SPRAYER DEVICE

FIELD OF THE INVENTION

The present invention relates to a sprayer device and more particularly it relates to a sprayer device for continuously spraying liquids such as water, detergents, sterilizing solutions, insecticides and the like. Most particularly the present invention relates to sprayer device with an improved mechanism of instantaneously shutting down the sprayer device without any dripping from its nozzle.

BACKGROUND ART OF THE INVENTION

There are a number or sprayer devices, which are commercially available in the market. One of the commercially available sprayer devices is shown in FIGS. 9 and 10. Referring first to FIGS. 9 and 10, the said sprayer device (1) comprises of pre-assembled parts, defined as a spraying mechanism (2) and a liquid storage tank (4). A predetermined type of liquid (3) is stored in the liquid storage tank (4).

The spraying mechanism (2) further comprises of a trigger member (5), a freely rotating axle (6), a suction valve (7), an exhaust valve (8), a piston member (15), a first spring member (16), a seesaw button means (19), a pressure accumulator (10) and a nozzle (14). The pressure accumulator (10) is provided with a platform (11) and a second spring member (12). The diametrical dimension of the said platform (11) is marginally smaller than the inner diametrical dimension of the pressure accumulator (10). One end of the said second spring member (12) is connected to the base of the pressure accumulator (4) while the other end is connected to the platform (11).

Referring to FIG. 9, it shows the said sprayer device (1) in its relaxed position. Said trigger member (5) is in its first position and is maintained in this position by the piston member (15) and the first spring member (16).

Now referring to FIG. 9, the working mechanism of the sprayer device (1) and other features not described earlier will be described now in detail. Firstly, a pre-determined amount of liquid (3) in poured in to the liquid storage tank (4). Then the spraying mechanism (2) is mounted onto the liquid storage tank (4). At this stage, the said sprayer device (1) is in its relax position or is not operated yet. Also, both the spring member (16, 12) is in their relax or first position.

When the said trigger member (5) is urged from its first position to its second position, the piston (15) is urged against the first spring member (16) and compressing the said first spring member (16). This will compress the air in a third liquid pipe (17). Said compressed air will apply pressure against the suction valve (8). When the trigger member (5) is released and is back in its first position, the said first spring member (16) will decompress and push the piston member (15) back to its original position. This will give the compressed air sufficient space to decompress. When the compressed air decompresses, it leaves a vacuum trail, which allows the suction valve to open and suck the liquid (3) from the liquid storage tank (4) through a first liquid pipe (9). At this stage, the said seesaw button (19), which is provided at the top of the sprayer device (1) seals a portion of a valve (18), sealing the liquid passage (18*b*) of the third liquid pipe (17) with one of its knob (19*b*). At the same time, another knob (19*a*) of the seesaw button (19) unseals another portion of the valve (18), allowing liquid to flow through the liquid passage (19*a*) in a second liquid pipe (13) to the nozzle (14), (FIG. 9).

When the trigger member (5) is urged to its second position again, similar action as mentioned earlier is repeated but instead of compressing air, liquid (3) is compressed and forced to flow through the exhaust valve (8) into the pressure accumulator (10). When the trigger member is released, it goes into its first position again. This continuous movement of the trigger member (5) from its first position to its second positions, results in the increase of volume of the liquid and increase of pressure in the pressure accumulator (10). As the pressure increases, said liquid pushes the platform (11) towards the base of the pressure accumulator (10) and at the same time compressing the second spring member (12). Some amount of the liquid in the pressure accumulator will flow through the second liquid pipe (13) towards another valve (not indicated) at the nozzle (14). When the decompression force of the second spring member (12) is greater than the liquid pressure in the pressure accumulator and when the valve can no longer restrain the decompression force of the second spring member (12), the said valve will open and allow the liquid to flow through the valve and exits through the nozzle (14).

Even though the movement of the trigger member is stopped, said liquid will still flow and exit through the nozzle (14). However, without the movements of the trigger member (5), the pressure in the pressure accumulator will reduce and slowly the said liquid will not be able to flow through the valve. To instantaneously cut out the flow of liquid to the nozzle, the seesaw button (19) is activated and the liquid passage way (18*a*) is sealed with the knob (19*a*). When the passage way (18*a*) is sealed, the passage way (18*b*) to the third liquid pipe (17) is unseal. At this stage, the flow of liquid will be diverted to the third liquid pipe (17) and finally into the liquid storage tank.

However, there is one draw back of the prior art spraying device. The trigger member (5) and the see saw button (19) operates independent of each other and are located at two different positions. The user has to use both his hands to operate the said device. This can be very inconvenient for the user at certain times.

The objective of the present invention is to introduce an improved sprayer device, which is capable of reducing the problems of liquid continuously dripping from the nozzle even after the flow of liquid has been shut down. Another objective of the present invention is to introduce an improved sprayer device, which can be operated with a single hand. Yet, another objective is to provide a sprayer that does not required the use of propellants such as gaseous material to increase the pressure in the sprayer device.

SUMMARY OF THE INVENTION

The present embodiment is a sprayer device, which comprises of a liquid storage tank for storing liquid and a spraying mechanism for spraying the liquid from the liquid storage through a nozzle. The spraying mechanism further includes a trigger member rotating about an axle and a piston member. Said piston member is moved by the movements of the trigger member. The said spring mechanism is also provided with a first pipe, a suction valve which is openalbe and closeable by the movements of the piston member, a pressure accumulator in which its bottom is supported by a spring member, an exhaust valve, a second pipe passing through the pressure accumulator to the nozzle, a third liquid pipe wherein one end is branched from the second liquid pipe while the other end is connected to the liquid storage tank, a seesaw button which is located diametrically opposite the trigger handle. Said seesaw button is provided to seal the second liquid pipe when the third liquid pipe is unseal and to seal the third liquid pipe when the second liquid pipe is unseal.

BRIEF DESCRIPTION OF THE FIGURES

The present invention will now be described by way of example with reference to the accompanying drawings, in which.

DETAILED DESCRIPTION OF THE INVENTION

Figure 1:
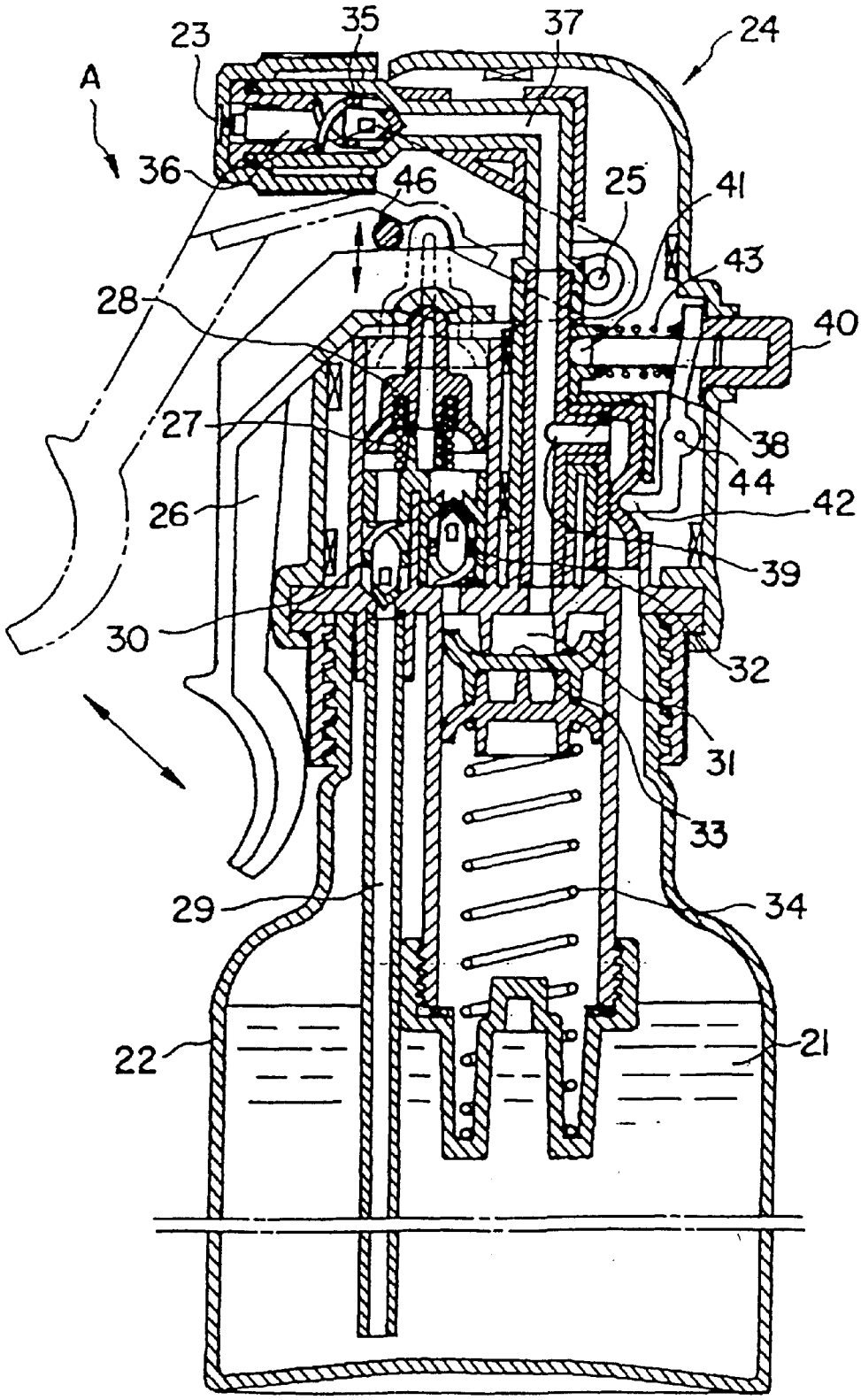
FIG. 1 is a cross sectional view of the present embodiment.
Figure 2:
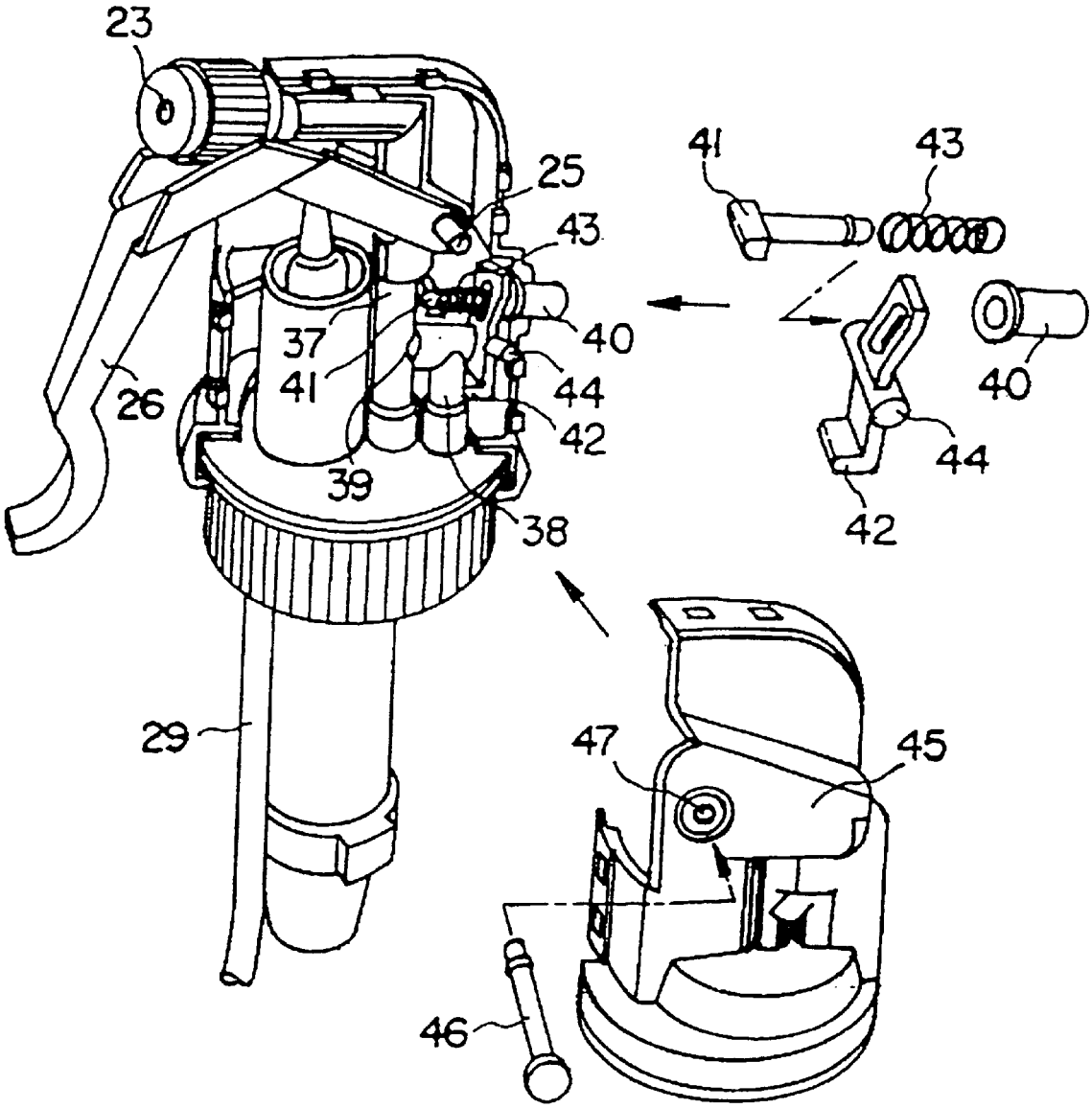
FIG. 2 is a perspective view of the spraying member and the cover of the present embodiment.

Referring to FIG. 1, a sprayer device (A) comprises of a liquid storage tank (22), which contains a liquid (21) therein preferably water, insecticide, paint and the like and a spraying mechanism (24). The spraying mechanism (24) further includes a nozzle (23), a trigger member (24) and a cover (45). Said cover is removeably mounted onto the spraying member (24). The said cover (45) further includes a stopper pin (46), which is introduceable in an aperture (47) on the cover (45) to secure the cover on the spraying member (24). Said cover (45) is designed to protect the spraying member (24) from damages.

The trigger member (26) is manually moved from its first to its second position. Said trigger member (26) is mounted onto the spraying mechanism (24) by means of a free rotating axle (25). At the bottom portion of the piston (28), a suction valve (30) and an exhaust valve (32), are provided wherein the suction valve is connected to a first liquid pipe (29) and the exhaust valve (32) is connected to a pressure accumulator (31).

Figure 4:
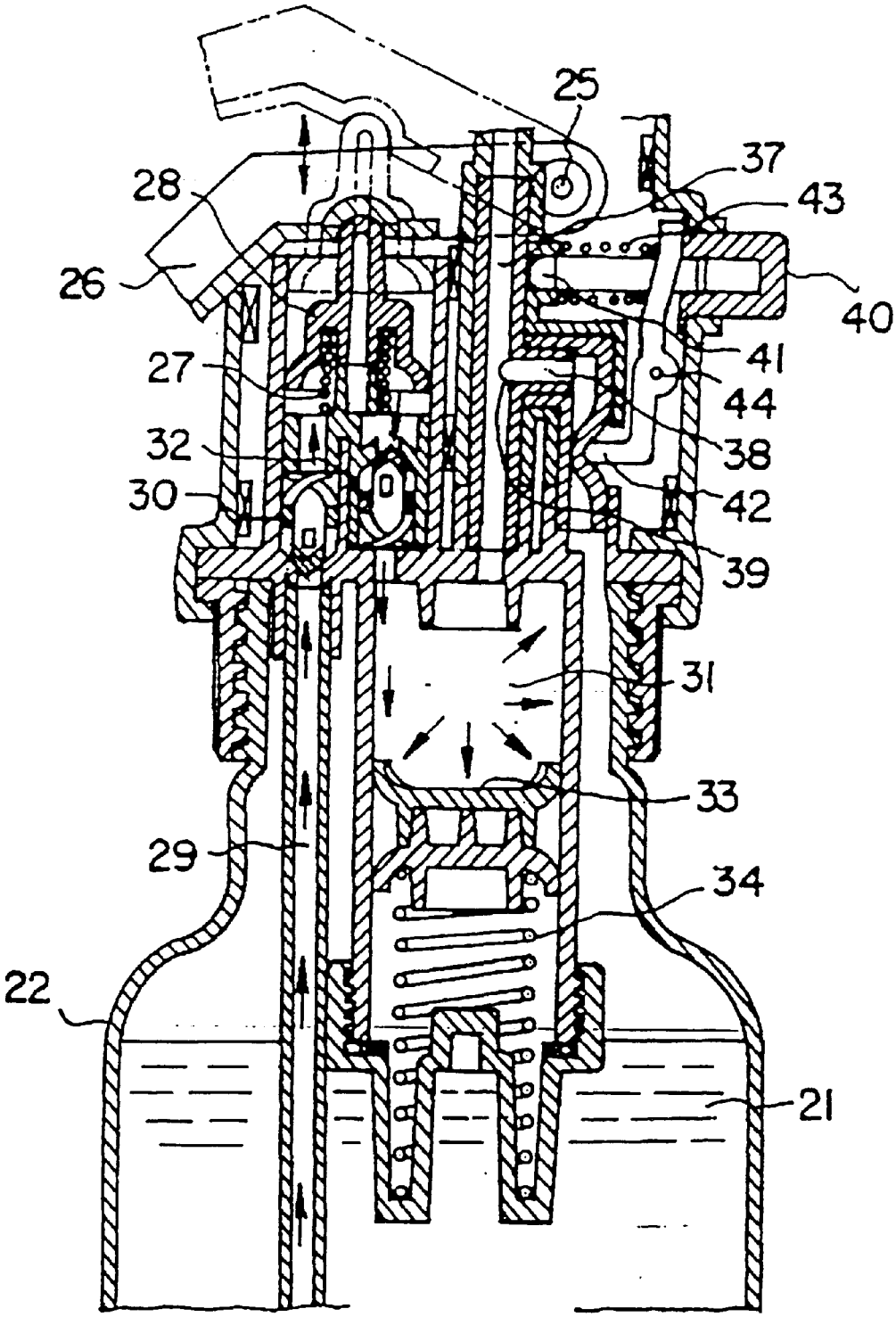
FIG. 4 is a cross sectional view of the present embodiment showing the movements of a trigger member and a piston.
Figure 5:
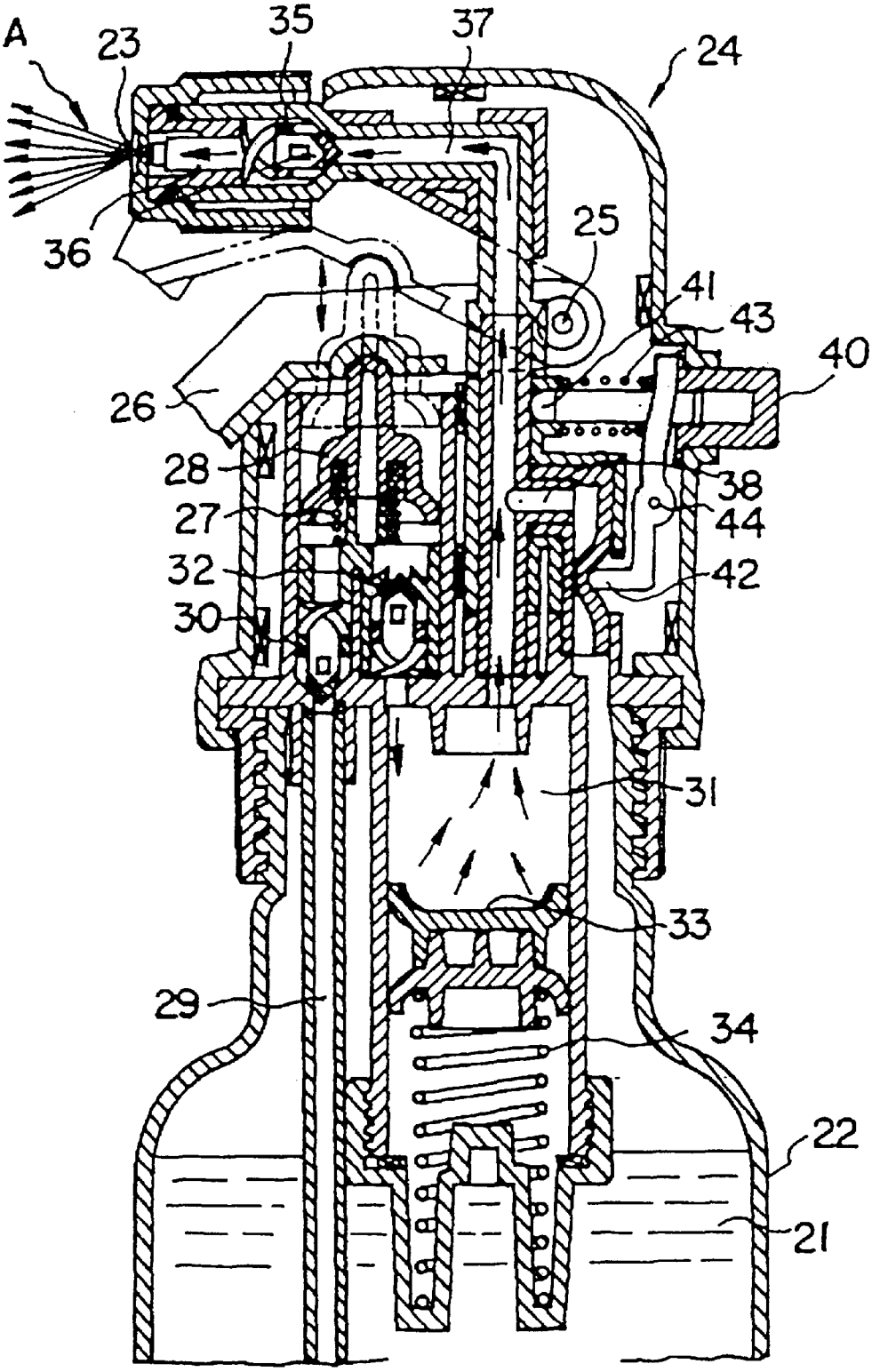
FIG. 5 is a cross sectional view of the present embodiment shown in FIG. 4 but with the cover.

A third liquid pipe (38) is also provided wherein one end is branched from the second liquid pipe (37) while the other end is connected to the liquid storage tank (31). A valve (39) is provided at the said branch point, (FIG. 4). Said valve (39) is sealed when spraying is in progress and when spraying is stopped, the valve (39) is opened and liquid is directed back to the liquid storage tank.

Figure 6:
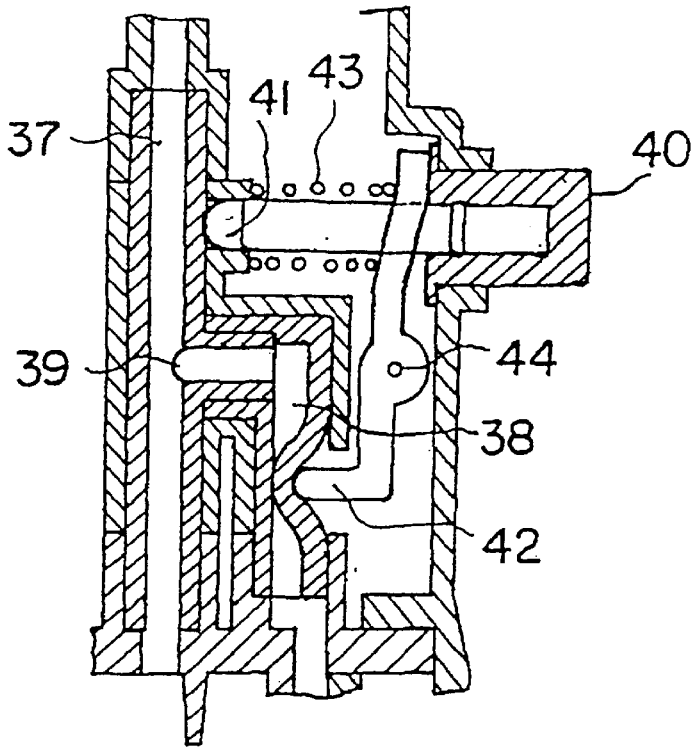
FIG. 6 is a cross sectional view of a portion of the spraying member showing the one of the knobs of the button means blocking the third liquid pipe.

A seesaw button (40), with a first knob (41) and a second knob (42) is also provided to seal and unseal the liquid passage ways in both the second and third liquid pipes. The said liquid pipes are made of soft plastics materials. When the spraying device is to be used, the liquid passage way in the third liquid pipe is sealed while the liquid passage in the second liquid pipe is open. The second knob (42) is pivoted in its mid portion to the spraying device. When one end of the second knob (42) is pushed away from the second liquid pipe, it compresses a spring member (43). The other end of the second knob (42) will move towards the third liquid pipe and push the perimeter side wall of the third liquid pipe until the passage way is totally sealed. At the same time, the first knob (41) moves in the direction away from the perimeter sidewall of the second liquid pipe (37) and creates a liquid passage way for the liquid to flow, (FIG. 6).

Figure 7:
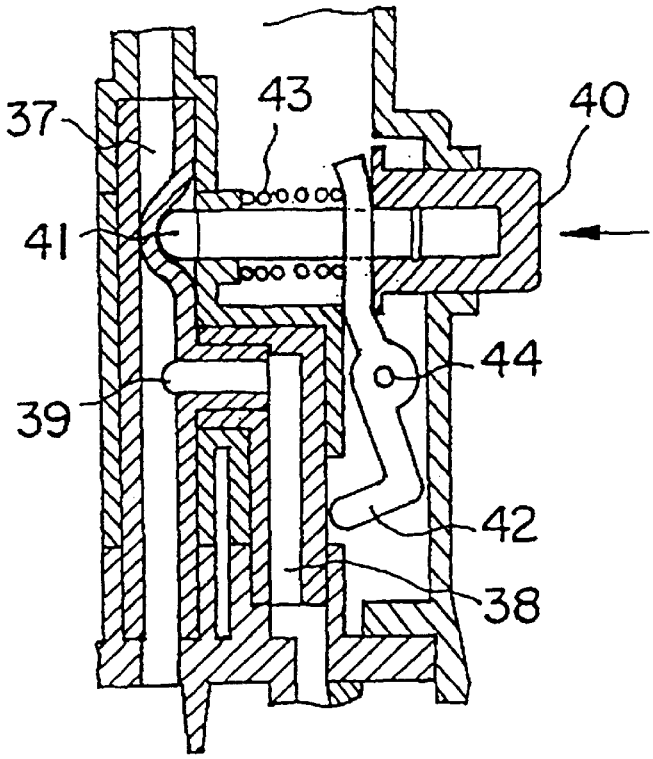
FIG. 7 is a cross sectional view of a portion of the spraying member showing the one of the knobs of the button means blocking the second liquid pipe.
Figure 8:
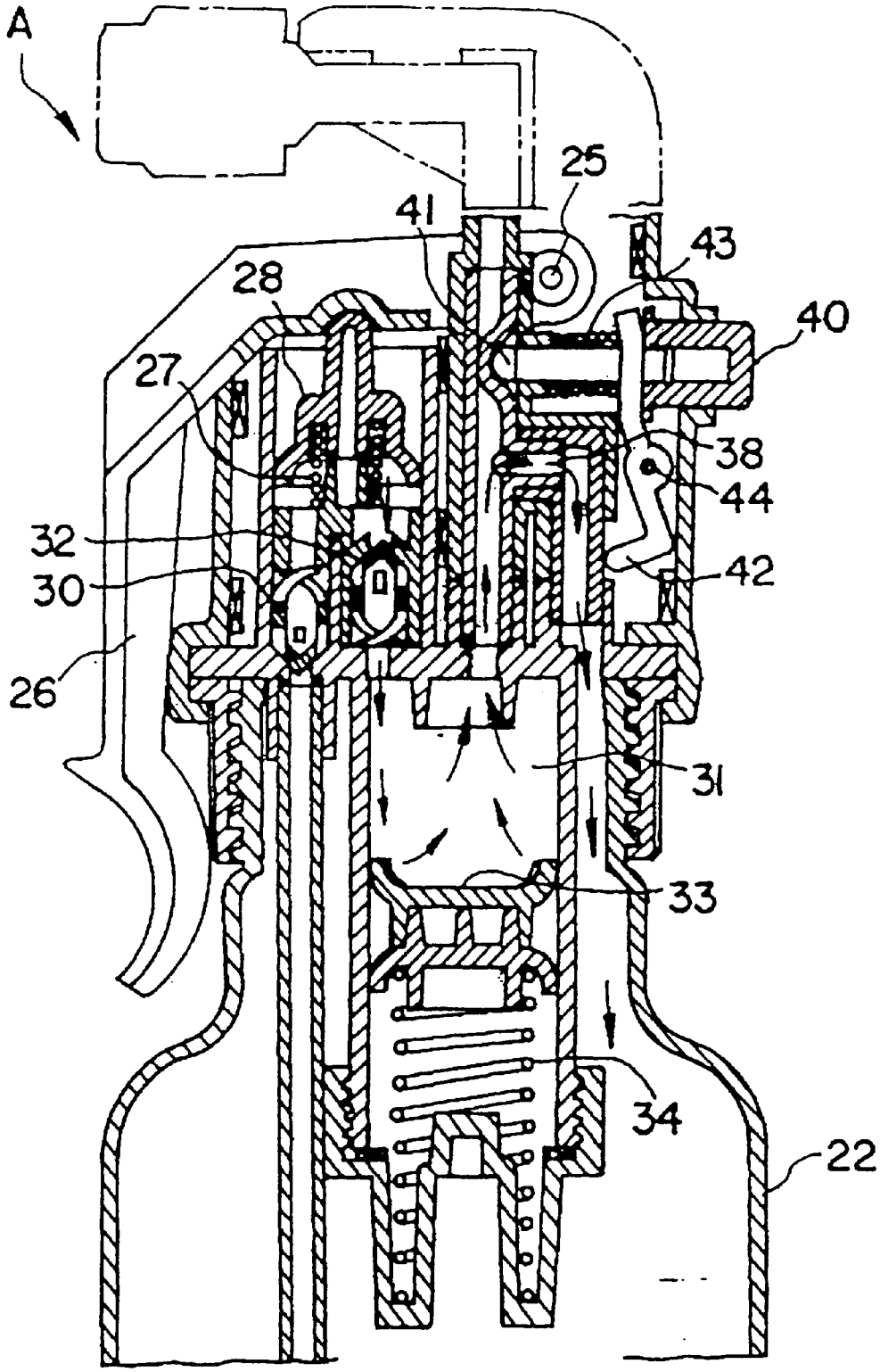
FIG. 8 is a cross sectional view of the present embodiment when the spraying device is not in use.
Figure 9:
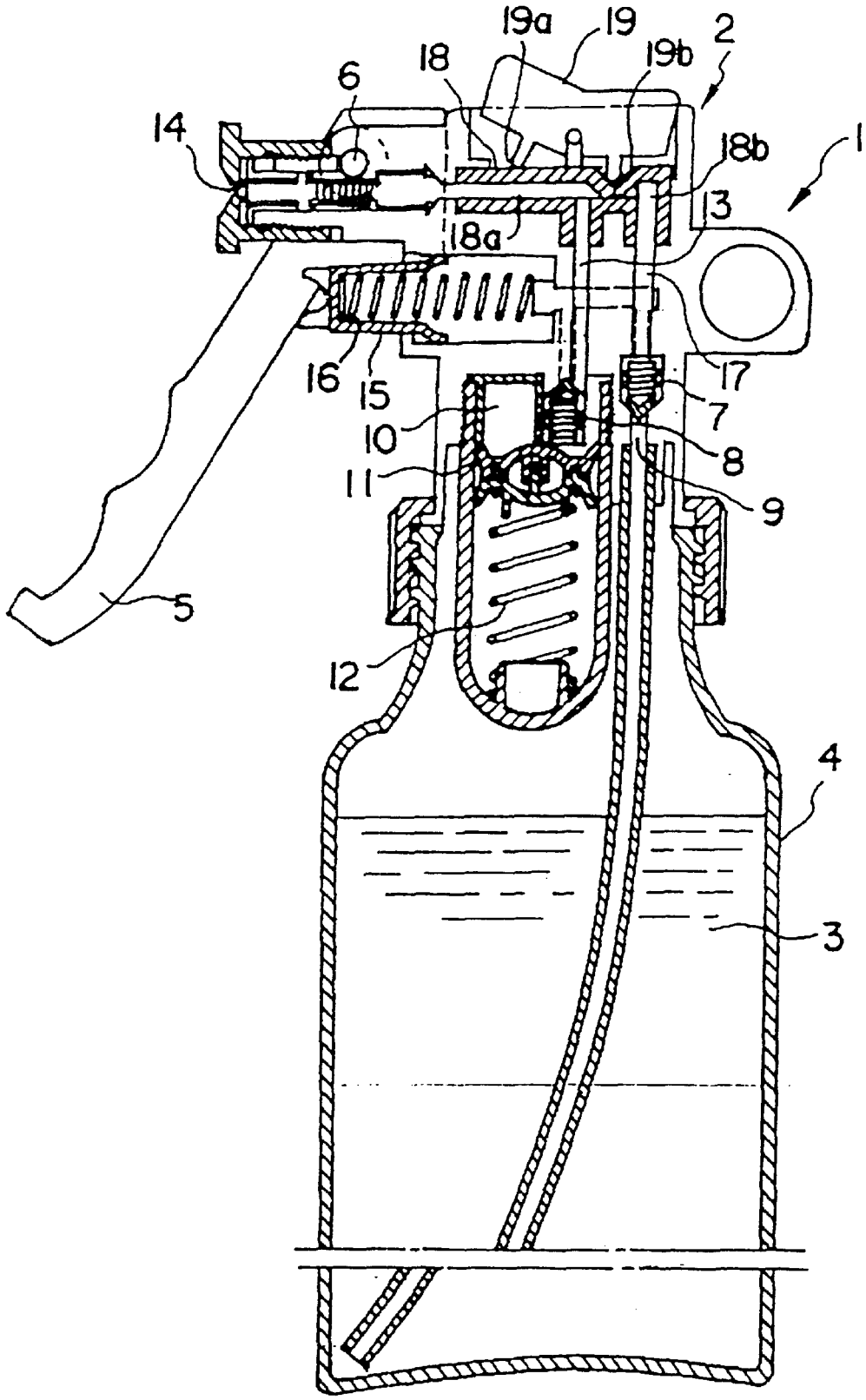
FIG. 9 is a cross sectional view of a prior art spraying device.
Figure 10:
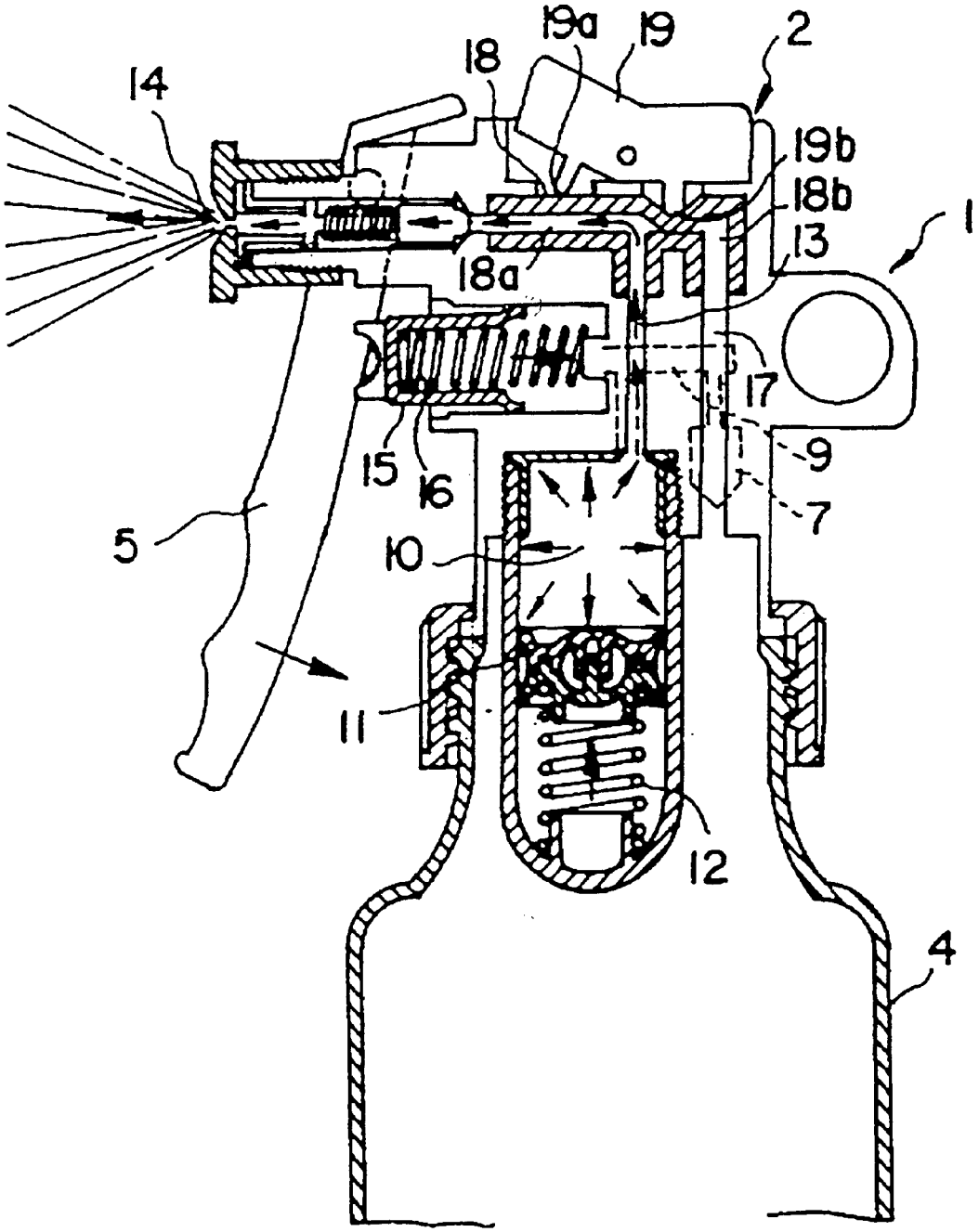
FIG. 10 is a cross sectional view of the spraying device shown in FIG. 9 when in use.

On the other hand, when linear force is applied on the seesaw button (40) as indicated by an arrow in FIG. 7, the first knob (41) will be pushed towards the perimeter sidewall of the second liquid pipe (37) until the liquid passage way is totally sealed. At the same time, one end of the second knob (42) will move in the opposite direction of the movements of the first knob (41) and resulting in opening the liquid passage-way to allow the liquid to flow through the said third liquid pipe into the liquid storage tank, (FIG. 7). At this stage, the said spraying device is in a deactivated position. In other words, the spraying device is not in use at this stage.

Figure 3:
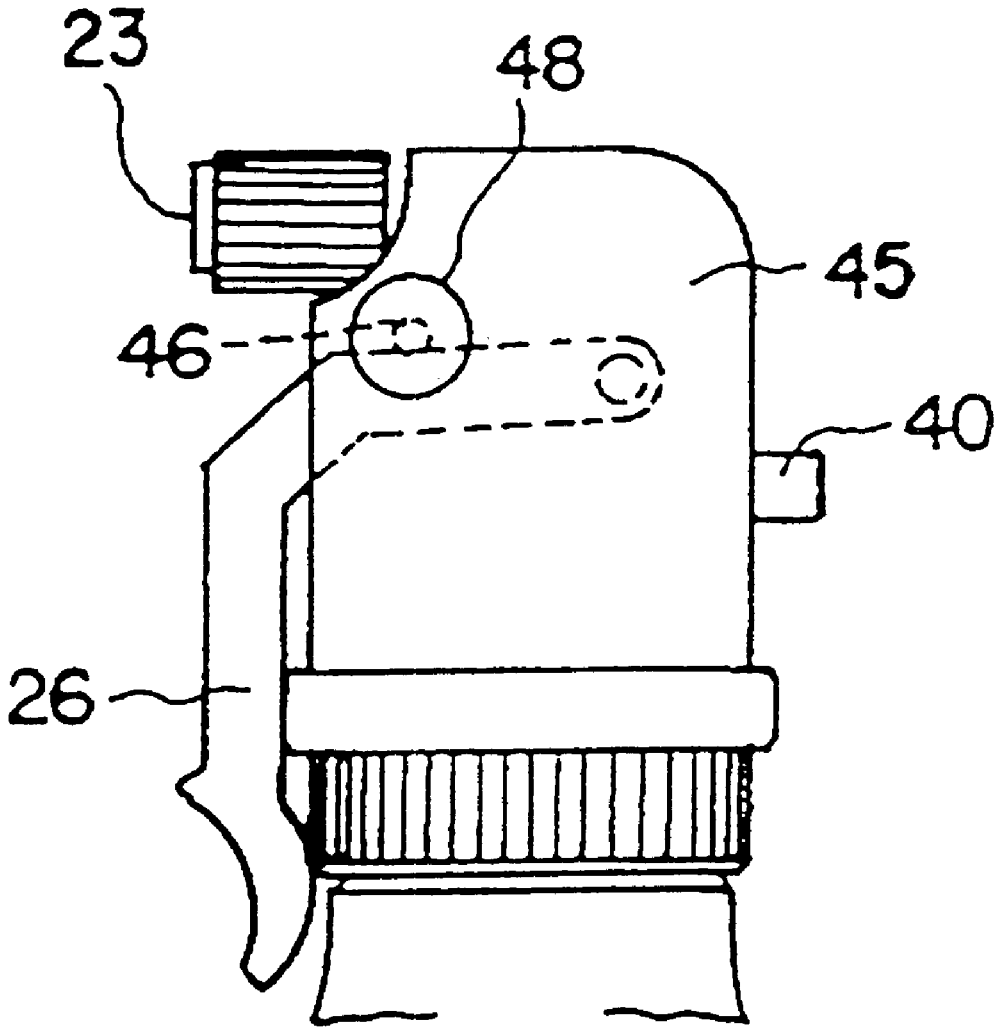
FIG. 3 is a side view of the spraying member held within its cover.

When the sprayer device (A) is not in use or being stored, the trigger member (26), which is in its first position (dotted line) and which is locked or connected to a piston (28) is urged against a spring member (27) in the spraying member (24), (FIG. 1). When further movement of the trigger member (26) towards the spraying mechanism is restricted, the stopper pin (46) is inserted into the aperture (47) to ensure that the trigger member (26) stays securely in its second position, (FIG. 1 and FIG. 3). Optionally, a seal means (48) can be provided to the stopper pin (46) to prevent the stopper pin (46) from slipping out of the aperture (47), (FIG. 3). During operation, the stopper pin (46) is removed from the aperture (47) and the trigger member (26) can freely be moved from its second position to it first position or vice versa repetitiously.

When the sprayer device (A) is operated, the trigger member (26) is moved from its first position to its second position as indicated by an arrow in FIG. 1. Such movement of the trigger member (26) will trigger the piston (28) to move upwards away from the exhaust valve (32) and suction valve (30) as shown in FIG. 4. The movements of the piston (28) will further result in the suction valve (30) to open and create a liquid passage way, for the liquid (21) from the liquid storage tank (22) to flow. Said liquid (21) will flow through the first liquid pipe (29) and move into the area between the piston (28) and the exhaust valve (32).

When the trigger member (26) is released and it moves to its first position by means of release force of the spring member (27), the piston (28) will move towards the exhaust valve (32) and the suction valve (30). The movement of the piston (28) will further result in the suction valve to close and the exhaust valve (30) to open and create a passage way for the liquid (21) to flow and be stored in the pressure accumulator (31). From the pressure accumulator (31), said liquid will flow to the nozzle (23) through the second liquid pipe (37).

The working mechanism of the said invention and other features not described earlier will be described now. As the trigger member (26) is repeatedly moved from its first position to its second position and vice versa, the liquid from the liquid storage tank will be sucked through the first liquid pipe (29) and travel through the suction valve (32) and exit through the exhaust valve (30) into the pressure accumulator (31). As this action is repeated, the liquid level and the pressure in the pressure accumulator (31) will increase. The said liquid, now in a pressurized form will force a platform (33) of the pressure accumulator (31) to move towards the base of the pressure accumulator and compresse a spring member (34), (FIG. 4). At this stage, the third liquid pipe (38) is sealed. When the decompressing force released by the compressed spring member (34) in the pressure accumulator (31) is greater then the force from the pressurized liquid, the liquid will be forced to flow in the second liquid pipe (37) and will force a valve (35), which is provided in the nozzle to open and create a liquid passage way for the liquid to flow.

When the sprayer device is to be shut down, the movement of the trigger member is stopped and is urged towards the spraying mechanism (24). When further movement of the trigger member (26) towards the spraying mechanism is restricted, the stopper pin (46) in inserted into the hole (47) to ensure that the trigger member (26) stays securely in its second position. At the same time, the seesaw button (40) is activated and the liquid passage in the third liquid pipe (38) is unsealed while the liquid passage in the second liquid pipe (37) is sealed. This will instantaneously stop the flow of liquid to the nozzle and redirect the liquid to the liquid storage tank.

The most distinguished feature of this invention against the prior art sprayer devices is that, the button means (40) is diametrically positioned opposite the trigger member (26). In this way, a user can operate both the trigger member (26) and the button means (40) at the same time and with one hand only.

In the present invention, as long as the liquid from the liquid accumulator is in a pressurized form, the liquid will be flow through the nozzle even without continuously engaging the trigger member.

What is claimed is:

1. A sprayer device (A) which comprises of a liquid storage tank (22) and a sprayer mechanism (24) for spraying liquid from the liquid storage tank (22) through a nozzle (23) and wherein said spraying mechanism (24) includes a trigger member (26) which rotates about an axle (25), a piston member (28) moveable by the trigger member (26), a first liquid pipe (29) which is provided with a suction valve (30) openable and closable by the movements of the piston member (28), a pressure accumulator (31) in which the bottom of the pressure accumulator (31) is supported by a spring member (34), an exhaust valve (32) which is openable and closable by the movements of the piston member (28), a second liquid pipe (37) passing trough the pressure accumulator (31) towards the nozzle (23), a third liquid pipe (38) branched off from the second liquid pipe (37) and passing through the liquid storage tank (22), a seesaw button (40) positioned diametrically opposite the trigger member (26) for the purpose of opening the second liquid pipe (37) when the third liquid pipe (38) is sealed and opening the third liquid pipe (38) when the second liquid pipe (37) is sealed.

2. A sprayer device as claimed in claim 1 wherein when the sprayer device (A) is not in use, the trigger handle (26) is urged towards the spraying mechanism (24) and a pin (46) is introduced in an aperture (47) to lock the trigger member (26) and stop the movements of the trigger member (26).

* * * * *